US006149322A

United States Patent [19]

Yale

[11] Patent Number: 6,149,322

[45] Date of Patent: Nov. 21, 2000

[54] X-RAY DEVELOPING MACHINE INCLUDING DEBRIS-CLEANING TRANSFER ARMS

[76] Inventor: Joyce K. Yale, 428 31st St., Hermosa Beach, Calif. 90254

[21] Appl. No.: 09/466,160

[22] Filed: Dec. 18, 1999

[51] Int. Cl.[7] ..... G03D 3/08

[52] U.S. Cl. ..... 396/619

[58] Field of Search ..... 396/612, 619, 396/617, 620, 636, 647

[56] References Cited

U.S. PATENT DOCUMENTS 3,882,525 5/1975 Zwettler ..... 396/622

4,125,852 11/1978 Brooks ..... 396/647

5,980,128 11/1999 Yale ..... 396/619

*Primary Examiner*—D. Rutledge

*Attorney, Agent, or Firm*—Hugh P. Gortler

[57] ABSTRACT

A transport unit of an intraoral dental x-ray developing machine includes a track and upper and lower transfer drives for moving film chips through tanks of developing, fixing and rinsing solutions. Transfer grooves in the track can become clogged with debris during normal operation of the x-ray developing machine. Projections extending from transfer arms of the lower transfer drive are provided to clean the debris from the grooves.

13 Claims, 3 Drawing Sheets

X-RAY DEVELOPING MACHINE INCLUDING DEBRIS-CLEANING TRANSFER ARMS

BACKGROUND OF THE INVENTION

The invention relates to x-ray developing machines. More specifically, the invention relates to the cleaning of 8-track intraoral dental x-ray developing machines.

Many dental offices have x-ray developing machines that can rapidly process intraoral dental x-ray films. These machines can develop as many as eight film chips simultaneously and quickly, usually in about four to six minutes. Such rapid processing allows a dentist to provide a quick diagnosis and immediate care to a patient. Additionally, these x-ray developing machines take up little office space. A space as small as a closet can be used as a darkroom for developing the film chips.

An x-ray developing machine that is commonly used in dental offices includes a transport unit having inner and outer walls that provide a curved track for the film chips to travel. One or more film chips are inserted through an entrance passageway and into the transport unit. Each film chip is moved along the track by a combination of gravity (during downward travel) and transfer drive arms (during upward travel). During its travel along the track, the film chip is immersed in a first tank filled with developing solution, a second tank filled with a fixing solution, and a third tank filled with water or another rinsing solution. After leaving the transport unit, the film chip is heated in a drying compartment and then passed through a series of rollers. Exiting the x-ray developing machine is fully developed film.

Each wall of the transport unit includes V-shaped transfer grooves. A function of the transfer grooves is to guide the film chips along the track, while minimizing contact with the walls so as not to damage the emulsion on the surfaces of the film chips.

However, precipitations of minerals (from the solutions) and other deposits (resulting from the developing and fixing action upon the film emulsion) accumulate in the transfer grooves. These deposits can block the passage of the film chips as the film chips are being pushed by the transfer drive arms and can cause the film chips to hop off the track. If a film chip becomes blocked, it might become scratched as it is forced off the track. Consequently, another x-ray will have to be retaken. If the film chip falls off the track and into the developer solution, it will be ruined by overdeveloping. Consequently, another x-ray will have to be retaken. If the chip falls into the fixer solution or rinsing solution, it can be saved but the machine will have to be partially disassembled in order to fish out the chip. If, however, the emulsion is badly scratched, which usually happens, the film will not be readable, and another x-ray will have to be retaken.

Retaking an x-ray is performed at a great annoyance and inconvenience to the patient, who is exposed to additional radiation, and to the dentist or x-ray technician, who has time taken away from his or her routine. To avoid these problems, the transport unit should be cleaned of the deposits on a daily basis.

Cleaning the transport unit can be messy and cumbersome. According to standard maintenance practice, the transport unit is removed from its housing and held over the tanks for a few seconds in order to allow excess solution to be drained. Care should be taken not to splash the solution; otherwise chemistry contamination might result. Additionally, the solution might drip on the floor or clothing, the latter of which would be stained permanently. After being drained, the transport unit is placed on a service tray and carried over to a large sink. There the transport unit is soaked, and the tracks are scrubbed with a brush to remove the deposits in the grooves. Once dried, the transport unit is reinstalled in the housing of the x-ray developing machine.

Removing the deposits from the transfer grooves is not easy. A toothbrush is recommended to clean the deposits from the grooves. However, the recommended toothbrush does not reach the vortex of the tracks. The transfer arms tend to get in the way. Consequently, cleaning of the tracks is difficult and incomplete. In frustration, a metal probe or instrument might be employed to scrape the track clean. The metal probe can fracture a delicate coating on the track. If the coating is fractured, the damaged tracks should be relined; otherwise, the film chips will be snagged and forced off the track.

Because of the difficulty and messiness of cleaning the transfer grooves, the cleaning is not performed as often as it should. Moreover, even when a track is cleaned, it is usually not cleaned well. On occasion, the tracks will be damaged.

There is a need for an easier, more efficient, more reliable, less cumbersome, less messy way of removing deposits from the transport unit of an x-ray developing machine.

SUMMARY OF THE INVENTION

According to one aspect of the present invention, an x-ray developing machine includes a film chip track containing a groove; a rotatable transfer arm having at least one surface that is movable along a surface of the film chip track; and a projection extending from the surface of the transfer arm. The projection, which conforms to size and shape of the groove, engages the groove when the surface of the transfer arm is moved along the film chip track.

The transfer arm cleans the grooves automatically and frequently, whenever the x-ray machine is being used. Deposits don't have the chance to accumulate in the grooves. The chance of a film chip hopping the track or becoming scratched is greatly reduced. Consequently, fewer x-rays are retaken. Thus eliminated is a source of frustration for dentists and patients.

Manual cleaning is reduced to changing solutions. Reducing the manual cleaning saves technician time and avoids damage to the track surface. The occasional cost of relining the track is eliminated, and the splashing and dripping of solution is reduced. Clothing is not stained, and chemistry contamination does not occur during automatic cleaning.

DETAILED DESCRIPTION OF THE PREFERRED EMBODIMENT

Figure 1:
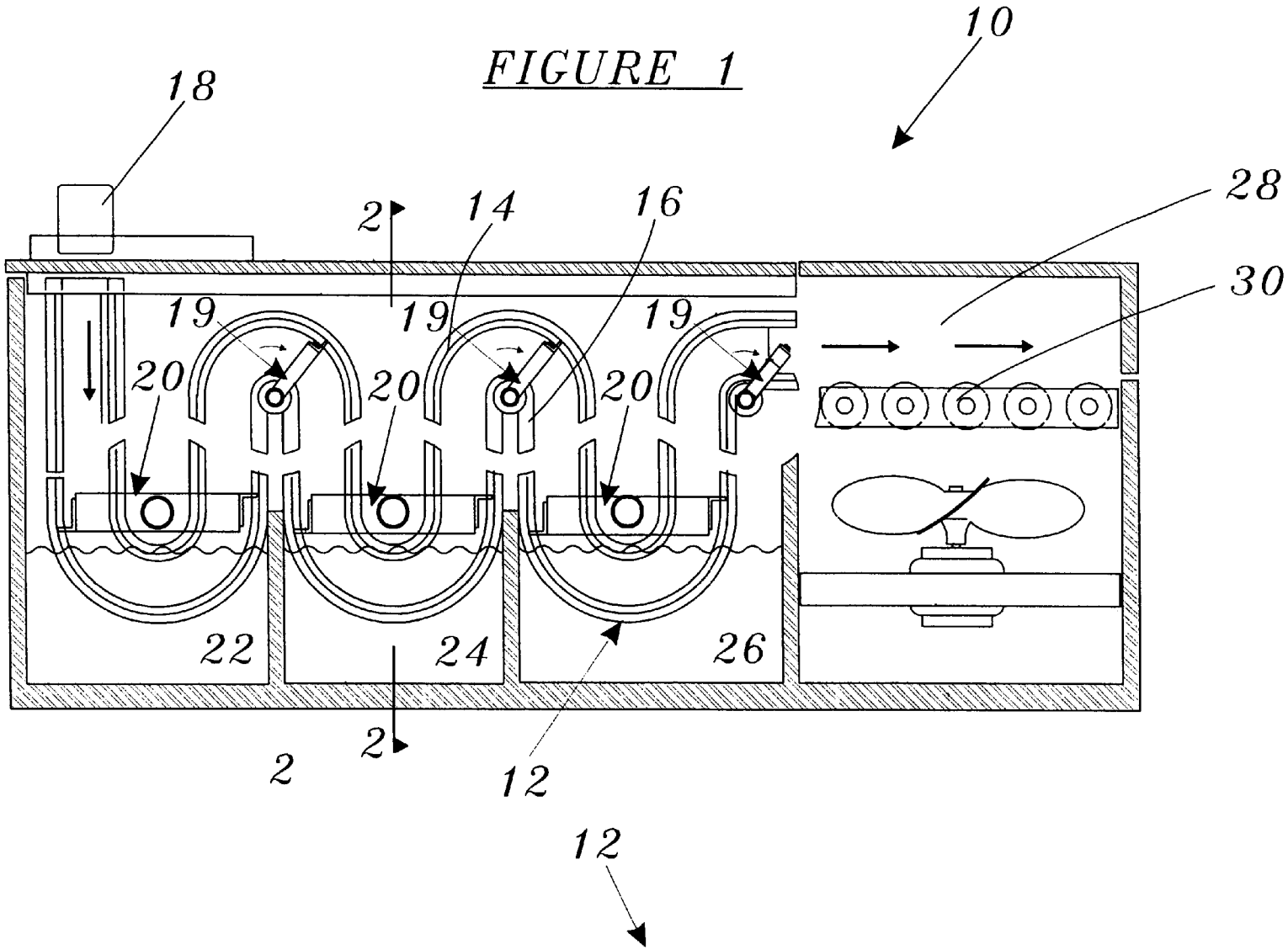
FIG. 1 is an illustration of an x-ray developing machine.

FIG. 1 shows an 8-track intraoral dental x-ray developing machine 10 including a transport unit 12 having upper and lower walls 14 and 16 that provide a curved track for film chips to travel. During normal operation of the x-ray developing machine 10, one or more film chips are inserted through an entrance passageway 18 and into the transport unit 12. Each film chip is moved along the track by a combination of gravity (during downward travel) and six transfer drives 19 and 20 (during upward travel). During its travel along the track, the film chip is immersed in a first tank 22 filled with developing solution, a second tank 24 filled with a fixing solution, and a third tank 26 filled with a rinsing solution. After leaving the transport unit 12, the film chip is heated in a drying compartment 28 and passed through a series of rollers 30. Exiting the x-ray developing machine 10 is fully developed film.

Figure 2:
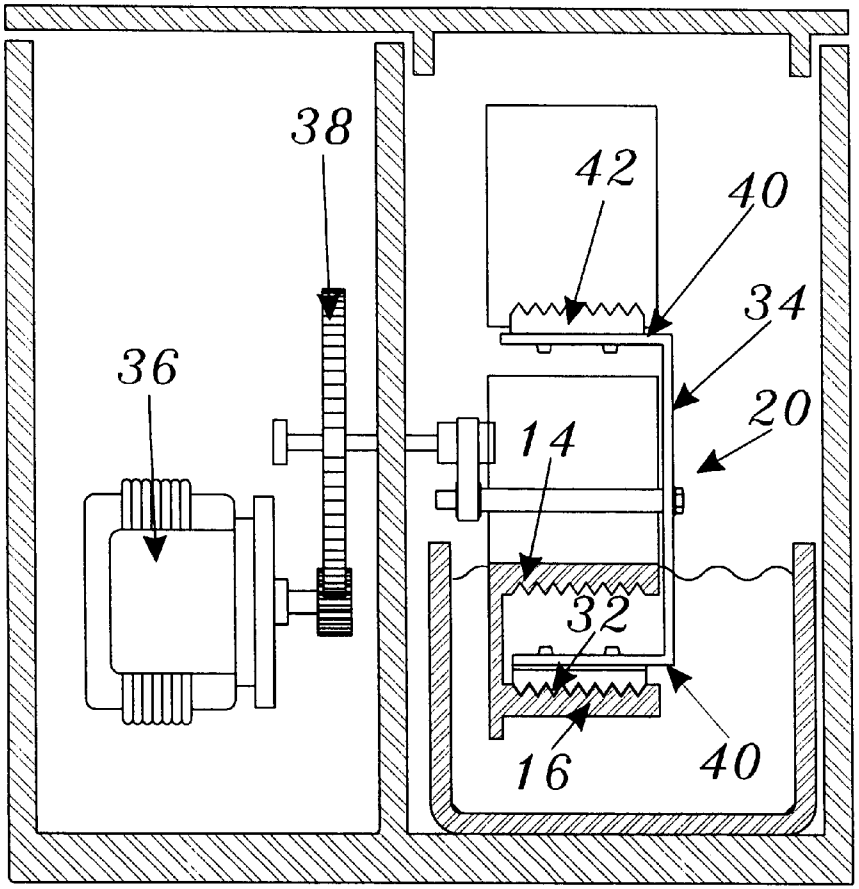
FIG. 2 is a cross-sectional view of a transport unit, which forms a part of the xay developing machine, the cross-sectional view being taken along lines 2—2 of FIG. 1.

Additional reference is made to FIG. 2. The upper and lower walls 14 and 16 have transfer grooves 32 for guiding the film chips along the track, while minimizing contact with the walls 14 and 16 so as not to damage the emulsion on the surfaces of the film chips. During operation of the x-ray machine 10, the transfer drives 20 are rotated by a motor 36 and transmission 38 (e.g., gears and a belt) to move a film chip along the track.

Of the six transfer drives 19 and 20, three are upper transfer drives 19 and three are lower transfer drives 20. Each transfer drive 19 or 20 includes a transfer arm 34 having at least one surface 40 that is movable along a surface of the film chip track. A series of projections 42 extend from the surface 40 of the transfer arm 34 of each lower transfer drive 20. The projections 42 conform to the size and shape of the transfer grooves 32. The projections 42 extend into the transfer grooves 32 of the lower track 16 while the surface 40 of the transfer arm 34 is being moved along the lower track 16.

When the x-ray machine 10 is turned on, the transfer arms 34 are rotated and the projections 42 are moved through the grooves 32 in the lower track 16. Any debris that has been deposited in the grooves 32 of the lower track 16 is pushed aside and crumbles into harmless powder. The powder falls into the tanks 22, 24 and 26. Thus, the grooves 32 are scraped clean whenever the x-ray machine is turned on.

The transfer drive arms of the upper transfer drives 19 will usually not need cleaning projections since gravity will usually prevent deposits from forming in the transfer grooves of the upper track 14. If, however, deposits can form in the transfer grooves of the upper track 14, the transfer drive arms of the upper drive 19 may also be provided with projections 40.

Figure 3:
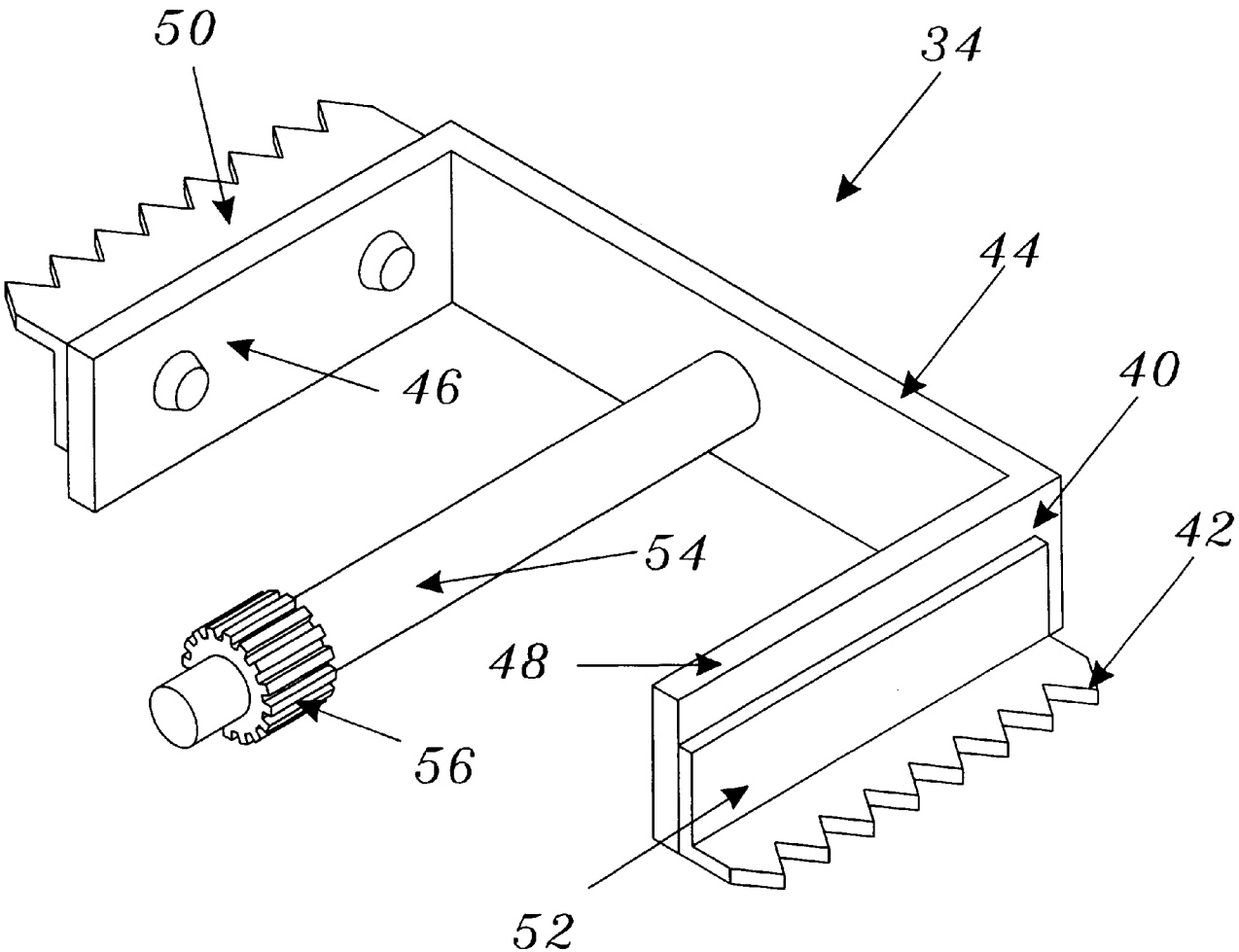
FIG. 3 is a perspective view of a transfer arm of the transport unit.

FIG. 3 shows a transfer drive arm 34 in greater detail. The transfer drive arm 34 includes first, second and third members 44, 46 and 48. The second and third members 46 and 48 are attached to opposite ends of the first member 44. The first member 44 extends in a first direction, and the second and third members 46 and 48 extend in a second direction. The first direction is about orthogonal to the second direction. First and second brackets 50 and 52 including the projections 42 are secured to the outer surfaces 40 of the second and third members 46 and 48. The projections 42 also extend outward along the first direction.

A shaft 54 is attached to the first member 44. Rotating the shaft 54 causes the transfer drive arm 34 to be rotated. A gear 56 at a free end of the shaft is provided to engage the transmission 38.

For a typical x-ray developing machine 10 that accepts up to eight #2 x-ray film chips, a transfer drive 20 may have eight projections 42 extending from each surface 40. Not all of the grooves 32 need to be engaged during a cleaning operation.

Thus disclosed is an x-ray machine including transfer arms that clean track grooves automatically, frequently and reliably, whenever the x-ray machine is turned on. Deposits don't have the chance to accumulate in the grooves. The chance of a film chip hopping the track or becoming scratched is greatly reduced. Consequently, fewer x-rays have to be retaken. Thus eliminated is the frustration of dentists and patients by not having to retake x-rays.

Manual cleaning is reduced to changing solutions. Reducing the manual cleaning saves technician time and avoids damage to the track surface. The occasional cost of relining the track is eliminated, and the splashing and dripping of solution is reduced. Clothing is not stained, and chemistry contamination does not occur during automatic cleaning.

A specific embodiment of the invention have been described and illustrated above. However, the invention is not limited to the specific form so described and illustrated. Instead, the invention is construed according to the claims that follow.

I claim:

1. An x-ray developing machine comprising:

a film chip track containing a groove;

a rotatable transfer arm having at least one surface that is movable along a surface of the film chip track; and a projection extending from the surface of the transfer arm, the projection conforming to size and shape of the groove, the projection engaging the groove when the surface of the transfer arm is moved along the film chip track.

2. The machine of claim 1, wherein the transfer arm includes first and second members, the first member extending in a first direction, the second member extending in a second direction, the first direction being about orthogonal to the second direction, a first group of the projections extending from an outer surface of the second member, the first group of projections extending in the first direction.

3. The machine of claim 2, wherein the transfer arm further includes a third member extending in the second direction, the second and third members being attached to opposite ends of the first member, wherein a second group of the projections extend from an outer surface of the third member, the second group of projections also extending along the first direction.

4. The machine of claim 2, wherein a bracket includes the projections, and wherein the bracket is attached to the outer surface of the second member.

5. The apparatus of claim 1, wherein the transfer drives include a plurality of upper drives and a plurality of lower drives, and wherein projections extend from the transfer drive arms of the lower drives.

6. The apparatus of claim 1, wherein the transfer arms, the projections and the grooves are sized for an intraoral dental x-ray developing machine.

7. An x-ray developing machine comprising:

a transport unit having first and second walls, the first and second walls including a plurality of grooves, the walls forming a film chip track;

a motor;

a plurality of transfer drive arms mechanically coupled to the motor; and a plurality of projections extending from at least one free end of at least one transfer drive arm, the projections matching the grooves in dimension and contour, the projections engaging at least some of the grooves when the motor is driving the at least one transfer drive arm.

8. The apparatus of claim 7, wherein the transfer drives include a first plurality of transfer drive arms which are part of upper transfer drives, and a second plurality of transfer drive arms which are part of lower transfer drives; and wherein the projections extend from the transfer drive arms of the lower drives.

9. The machine of claim 8, wherein the transfer arm of each lower transfer drive includes first and second members, the first member extending in a first direction, the second member extending in a second direction, the first direction being about orthogonal to the second direction, a first group of the projections extending from an outer surface of the second member, the first group of projections extending in the first direction.

10. The machine of claim 9, wherein the transfer arm further includes a third member extending in the second direction, the second and third members being attached to opposite ends of the first member, wherein a second group of the projections extend from an outer surface of the third member, the second group of projections also extending along the first direction.

11. A transfer drive for an x-ray developing machine, the machine including a transport unit having a film chip track, the track having a plurality of grooves, the transfer drive comprising:

an arm having an outer surface; and a plurality of projections extending outward from the outer surface of the arm, the projections conforming to size and shape of the track grooves.

12. The transfer drive of claim 11, wherein the arm includes first and second members, the first member extending in a first direction, the second member extending in a second direction, the first direction being about orthogonal to the second direction, the projections extending from an outer surface of the second member, the first group of projections extending in the first direction.

13. The transfer drive of claim 12, wherein the transfer arm further includes a third member extending in the second direction, the second and third members being attached to opposite ends of the first member, wherein additional projections extend from an outer surface of the third member, the additional projections also extending along the first direction.

* * * * *